United States Patent [19]

Wilson et al.

[11] Patent Number: 4,776,813

[45] Date of Patent: Oct. 11, 1988

[54] SEALED CONNECTOR ASSEMBLY

[75] Inventors: Bill B. Wilson, Montgomery; Robert J. Gugelmeyer, Aurora; Stephen A. Colleran, Lisle, all of Ill.

[73] Assignee: Molex Incorporated, Lisle, Ill.

[21] Appl. No.: 130,144

[22] Filed: Dec. 8, 1987

[51] Int. Cl.[4] ..... H01R 13/424

[52] U.S. Cl. ..... 439/587; 439/595

[58] Field of Search ..... 439/271, 274, 275, 595, 439/586, 587, 588, 589, 596, 597, 598, 599, 600, 601, 603

[56] References Cited

U.S. PATENT DOCUMENTS

| | | | |
|---|---|---|---|
| 4,497,531 | 2/1985 | Baker | 439/271 |
| 4,714,437 | 12/1987 | Dyki | 439/595 |
| 4,740,177 | 4/1988 | Heimbrock | 439/603 |

*Primary Examiner*—Neil Abrams

*Attorney, Agent, or Firm*—John W. Cornell; Louis A. Hecht

[57] ABSTRACT

An improved sealed connector includes at least one terminal with an associated terminated conductor. The sealed connector includes a housing having at least one resilient arm with a free end finger extending within a terminal receiving channel for retaining the terminal within the terminal receiving channel. The housing includes a sleeve portion extending axially outwardly from a terminal entry wall defining a seal receiving cavity. A seal has at least one aperture for receiving the terminal and is disposed within the seal receiving cavity between the housing terminal entry wall and a connector cover. The connector cover includes terminal position assurance means and a keying member cooperating with the housing terminal retaining arm for securing the terminal within the terminal receiving channel and for keying alignment with the housing and the seal. The housing and the connector cover include cooperating locking mechanisms for securing said connector cover to the housing. A sealed connector subassembly includes the sealed connector housing, the connector cover and the seal. The housing and the connector cover include cooperating latching means for securing the connector cover to the housing in a subassembly position.

21 Claims, 4 Drawing Sheets

SEALED CONNECTOR ASSEMBLY

The present invention relates to sealed connectors and more particularly to a sealed connector and sealed connector subassembly including a housing for receiving at least one terminal terminating a conductor, a conductor entry seal and a connector cover.

BACKGROUND OF THE INVENTION

Sealed connectors are known for use in environments such as automobiles for environmentally sealing the electrical connections to prevent damage from moisture and other contaminants. One example of a sealed electrical connector is disclosed in U.S. Pat. No. 4,497,531 issued Feb. 5, 1985 to Baker.

Disadvantages of known sealed connectors include complexity and the resulting difficulty and time required for assembly.

It is desirable to provide a sealed connector permitting the removal of a terminal for repair or replacement. However, the construction of many prior art connectors makes it very difficult if not impossible to replace terminals without destroying the connector or the integrity of the seal. For this reason it is desirable to avoid the use of a terminal locking tang for retaining the terminal in the connector housing. However it is important to retain and securely position terminals within the connector so that a reliable electrical connection is maintained, for example, if the external terminated conductor is moved or pulled.

Also, it is desirable to provide a unitary subassembly for receiving terminals each with a terminated conductor. Such a unitary sealed connector subassembly should be adapted for automated assembly. Many prior art sealed connectors are provided as multiple parts for assembly by the user. Hence, possible misassembly and/or contamination with foreign material or dirt prior to assembly is a problem. This problem could be solved by a unitary subassembly.

SUMMARY OF THE INVENTION

It is a primary object of the present invention to provide an improved sealed connector. Other important objects are to provide a sealed connector that is simple and inexpensive to make and to assemble; to provide a sealed connector having a small size; to provide a sealed connector including terminal locking and terminal position assurance features; to provide a sealed connector in which terminals can be released and replaced; to provide a subassembly in which terminals with terminated conductors can be easily inserted without the necessity for special care or skilled labor; to provide such subassembly in which a connector cover, a conductor entry seal and a housing are mechanically secured and precisely aligned in a simple and automatic manner; and to provide a sealed connector and a sealed connector subassembly overcoming disadvantages of those used in the past.

In brief, the present invention provides an improved sealed connector including at least one terminal with an associated terminated conductor. The sealed connector includes a housing having at least one terminal receiving channel extending from a terminal entry wall toward an opposed mating wall. The housing has at least one resilient arm with a free end finger extending within each of the terminal receiving channels for retaining the terminal within the terminal receiving channel. The housing includes a sleeve portion extending axially outwardly from the terminal entry wall defining a seal receiving cavity. A connector cover has at least one aperture for receiving the terminal. A seal has at least one aperture for receiving the terminal and is disposed within the seal receiving cavity between the housing terminal entry wall and the connector cover. The connector cover includes terminal position assurance means cooperating with the housing terminal retaining arm for securing the terminal within the terminal receiving channel. The housing and the connector cover include cooperating locking means for securing the connector cover to the housing.

A sealed connector subassembly for receiving at least one terminal with an associated conductor includes the connector housing, the connector cover and the seals. The housing and the connector cover include cooperating latching means for securing the connector cover to the housing in a subassembly position.

BRIEF DESCRIPTION OF THE DRAWING

The present invention together with the above and other objects and advantages may best appear from the following detailed description of the embodiment of the invention shown in the accompanying drawing, wherein.

DETAILED DESCRIPTION OF THE PREFERRED EMBODIMENT

Figure 1:
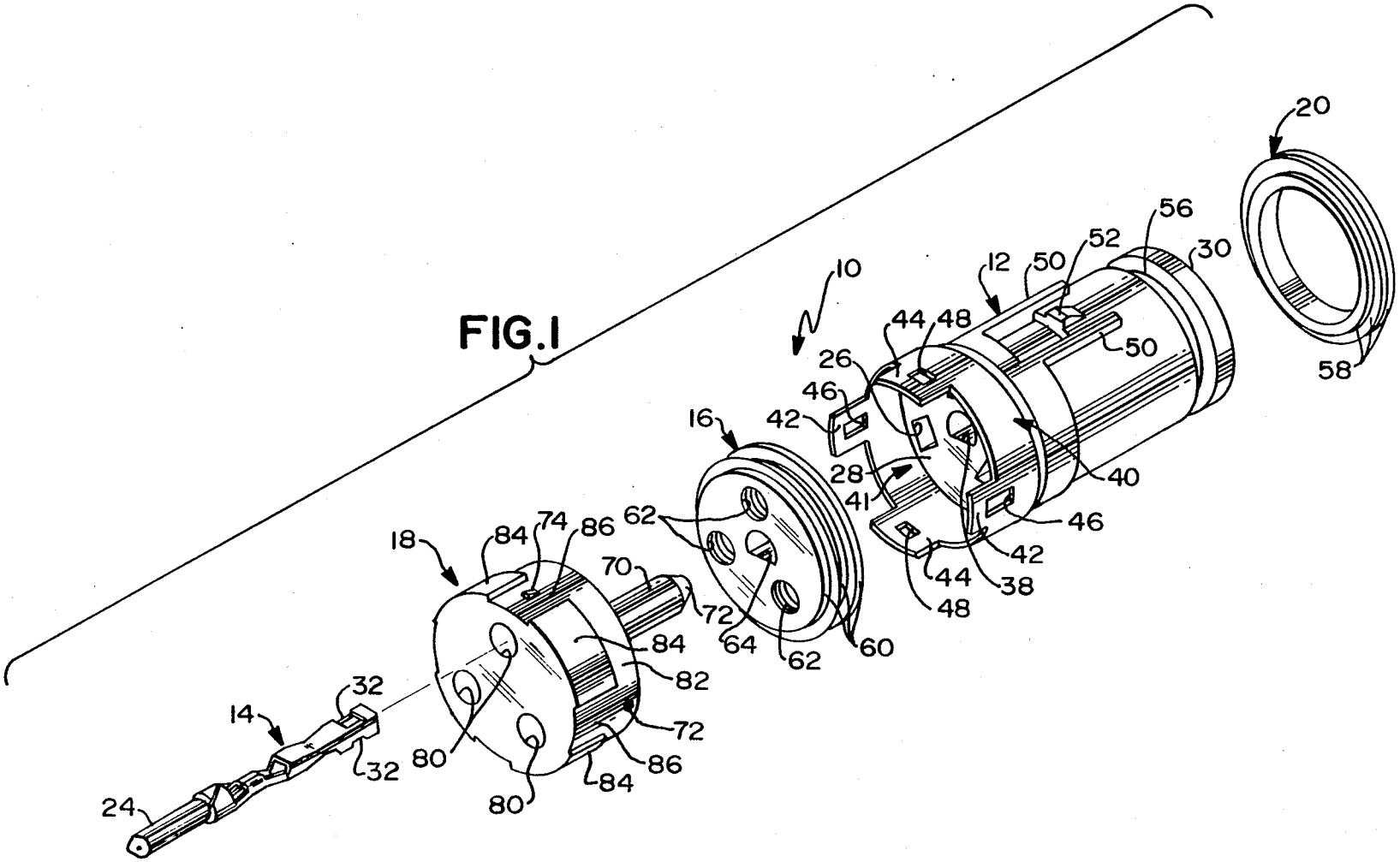
FIG. 1 is an exploded perspective view of a sealed connector constructed in accordance with the present invention and illustrating the components prior to assembly.

Having reference now to FIG. 1, there is shown in disassembled condition a sealed connector designated as a whole by the reference character 10 and constructed in accordance with principles of the present invention. Sealed connector 10 includes a housing 12 for receiving and releasably securing a plurality of terminals 14 (only one being shown for clarity), a conductor entry seal 16, a terminal position assurance and locking cover 18 and a mating connector seal 20.

Figure 2:
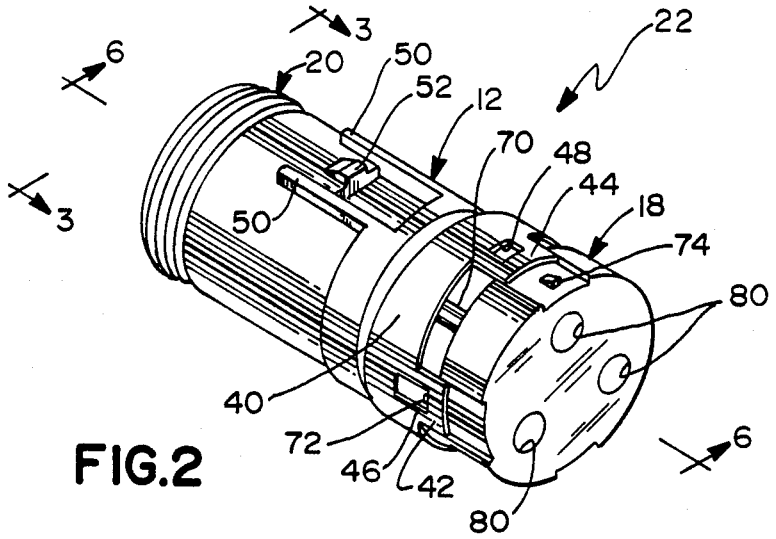
FIG. 2 is a perspective view of a subassembly of the sealed connector of FIG. 1 prior to the insertion of terminals with terminated conductors.
Figure 6:
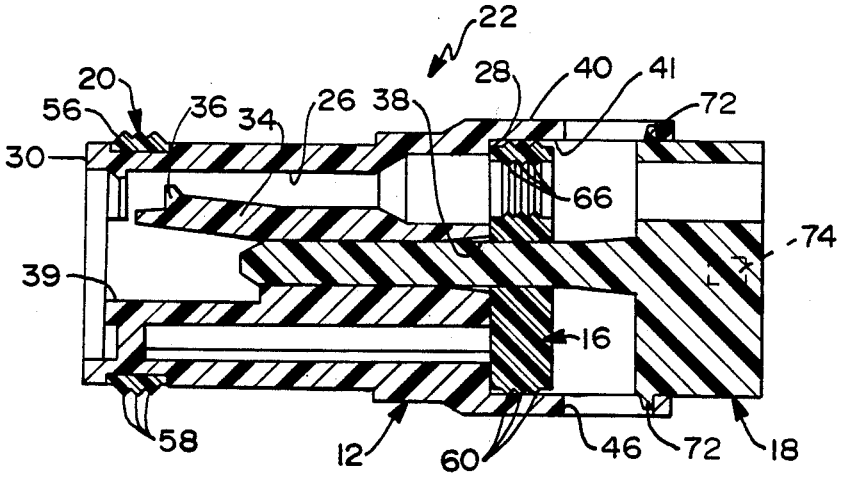
FIG. 6 is a sectional view taken along the line 6—6 of FIG. 2.
Figure 7:
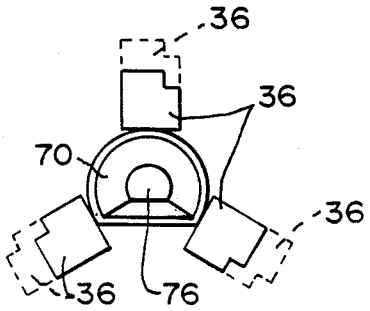
FIG. 7 is an enlarged, partial end view similar to the central part of FIG. 3 illustrating the housing locking fingers in an initial position in broken lines and in the terminal locking position in full lines.
Figure 4:
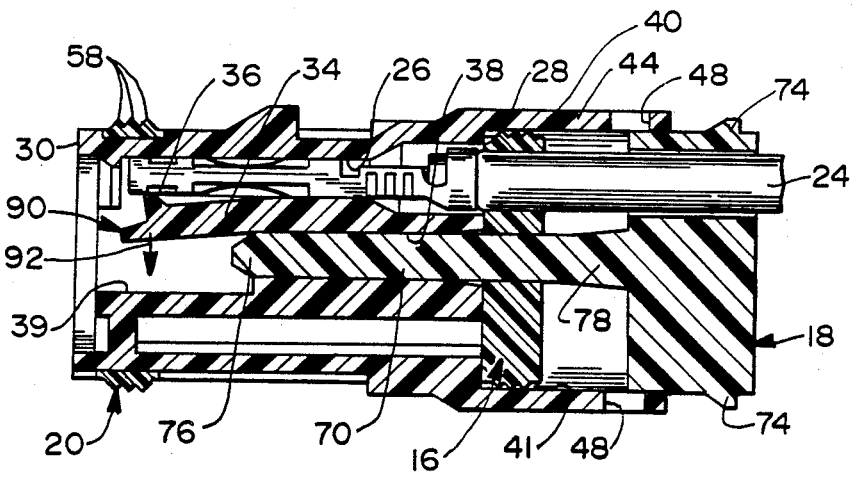
FIG. 4 is a sectional view taken along the line 4—4 of FIG. 3 showing the terminal after the insertion of a terminal with a terminated conductor.
Figure 5:
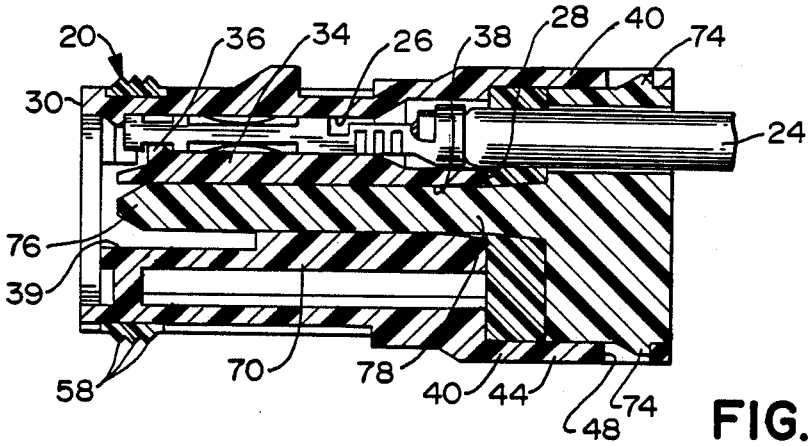
FIG. 5 is a sectional view similar to FIG. 4 illustrating the connector cover fully inserted in locking position.
Figure 10:
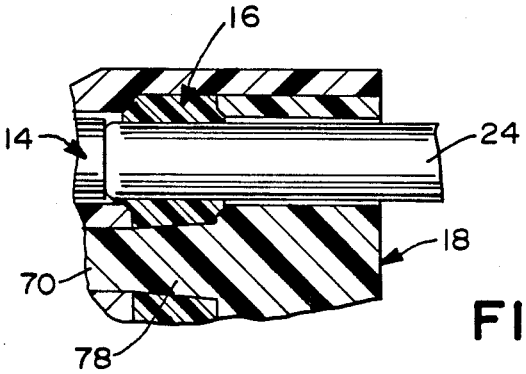
FIG. 10 is a fragmentary sectional view to illustrate the conductor seal inserted within the connector housing with a terminated conductor inserted.

Referring to FIG. 2, a sealed connector subassembly generally designated as 22 of the sealed connector 10 includes the housing 12, the conductor entry seal 16, the terminal position assurance and locking cover 18 and the rear connector seal 20 assembled together. Initially the cover 18 and housing 12 are preassembled or partly assembled together as seen in FIGS. 2, 4 and 6. An associated conductor 24 (FIGS. 4 and 5) is terminated by each of the terminals 14 prior to insertion into the sealed connector subassembly 22. After the terminals 14 with the terminated conductors 24 are inserted, the terminal position assurance and locking cover 18 is moved into a locking position with the housing 12 as shown in FIGS. 5 and 10.

Preferably, the sealed connector housing 12 is an integral, one-piece member formed of a strong, flexible electrically insulating material. A translucent plastic or similar material forms the housing 12 by conventional injection molding technique. Housing 12 includes a plurality of spaced-apart channels 26 extending from a terminal entry wall 28 to an opposed mating wall 30. Each of the channels 26 has a size and shape for receiving and orienting the terminal 14. As shown in FIG. 1, channels 26 have a generally rectangular shape to orient the terminal 14 so that either one of a pair of opposed locking windows 32 formed in each terminal 14 is positioned within the channel 26 facing radially inward.

Referring to FIGS. 3–7, housing 12 is formed with a resilient retaining arm 34 outwardly extending within each of the terminal-receiving channels 26. Each retaining arm 34 has a free end locking finger 36 to be received within the terminal locking window 32 for locking the terminal 14 in place in a channel 26 of the housing 12. Referring also to FIG. 1, housing 12 includes a centrally located, generally D-shaped elongated recess 38 extending inwardly from the terminal entry wall 28 into an opposed housing cavity 39 (FIGS. 4–6) for keying and terminal position assurance features of the connector cover 18. The terminal receiving channels 26 are arrayed at approximately 120 degree intervals around and are spaced from the central longitudinal axis of housing 12 and recess 38 with the retaining arms 36 positioned for movement within the housing cavity 39.

A sleeve 40 of the housing 12 extends axially outwardly from the terminal entry wall 28 defining a cavity 41 for receiving the conductor entry seal 16 and the connector cover 18. Sleeve 40 includes a plurality of spaced apart tab portions 42 and 44 having an aperture 46 and 48, respectively, cooperating with the connector cover 18 for securing the housing 12 with the connector cover 18 in the subassembly 22 and the sealed connector 10. As seen in FIG. 1, there are two diametrically opposed tabs 42 alternating with two diametrically opposed tabs 44. Apertures 48 are shorter in axial length than apertures 46.

Figure 3:
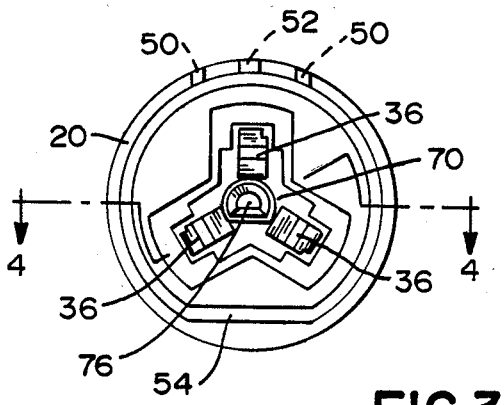
FIG. 3 is an end elevational view of the subassembly taken from the line 3—3 of FIG. 2.

For accurate keying alignment with a mating connector (not shown) housing 12 includes a pair of rails 50, a latch protuberance 52 and a flat wall portion 54 (FIG. 3). Rails 50, latch protuberance 52 and flat wall portion 54 are adapted to be received in corresponding portions of the mating connector. Terminal pins or blades of the mating connector are oriented for receipt within the terminals 14. Housing 12 includes a groove 56 for receiving and retaining the mating connector seal 20.

Preferably, the mating connector seal 20 and the conductor entry seal 16 are formed of an elastomeric material and impregnated with silicon oil or similar materials. A plurality of outwardly extending ribs 58 and 60 are defined by the outside surface of the mating connector seal 20 and the conductor entry seal 16, respectively. A cleaning wiping action of any contamination or foreign materials carried by the mating connector is provided by the first inserted rib 58. Effective compression sealing is provided by the subsequent ribs 58.

Figure 8:
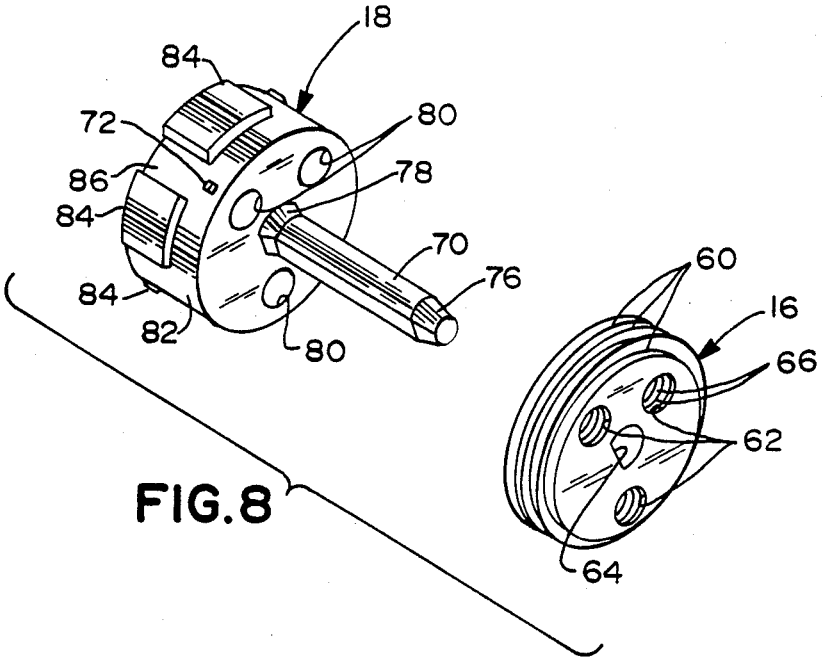
FIG. 8 is an exploded perspective view of the connector cover and the conductor entry seal of FIG. 1 prior to assembly.
Figure 9:
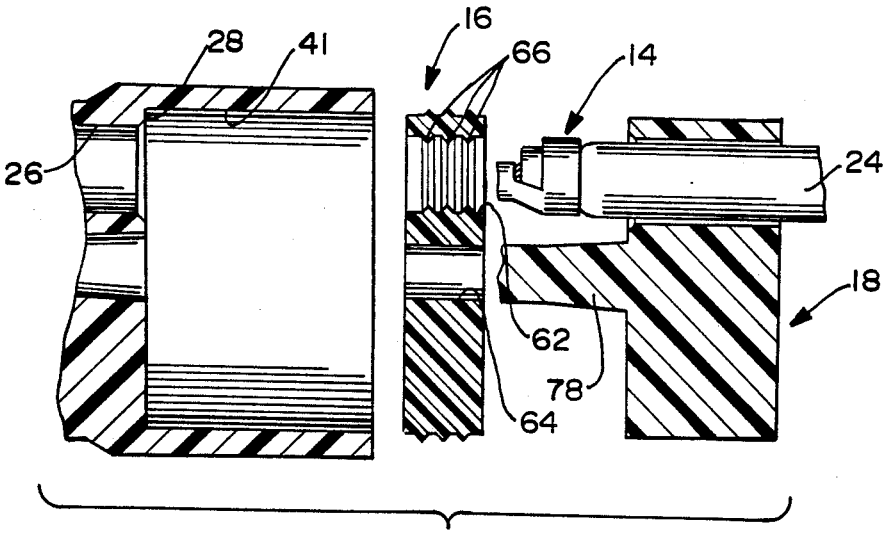
FIG. 9 is a fragmentary sectional view to illustrate the conductor entry seal relative to the connector housing and the terminated conductor.

Referring to FIGS. 1, 8 and 9, the conductor entry seal 16 has an overall size for press-fit insertion within the housing cavity 41. Conductor entry seal 16 includes a plurality of generally circular passageways 62 sized for interference fit engagement with the conductors 24 and a centrally located, generally D-shaped opening 64 for keying alignment with the connector cover 18. A plurality of outwardly extending ribs 66 are defined by an inside surface of each of the passageways 62. A first rib 66 provides a cleaning wiping action of any contamination carried by the inserted conductor 24 with the remaining ribs providing effective compression sealing with the inserted conductor.

In accordance with features of the invention, the terminal position assurance and locking cover 18 includes an axially extending elongated keying member 70, a pair of outwardly extending latching protuberances 72 received within housing apertures 46 for retaining the cover 18 in the preassembled or partly assembled condition within recess 41 of the housing 12 in the subassembly 22 (FIG. 2) and a pair of outwardly extending locking protuberances 74 received within housing apertures 48 for securing the cover 18 to the housing 12 in the final assembled condition of the sealed connector 10.

Keying member 70 has a generally D-shape for keying alignment within D-shaped opening 64 within the conductor entry seal 16 and within the centrally located D-shaped elongated recess 38 of the housing 12. Keying member 70 includes a tapered nose portion 76 that facilitates the sliding insertion within the seal opening 64 and the housing recess 38. Keying member 70 includes a tapered base portion 78 for enhanced compression sealing with the conductor entry seal 16 as illustrated in FIG. 10.

A plurality of spaced apart, generally circular shaped apertures 80 extend through a body portion 82 of the terminal position assurance and locking cover 18 for receiving and orienting the terminals 14. A plurality of radially extending ledges 84 define mating recesses 86 for receiving the housing tabs 42 and 44.

Referring to FIGS. 2 and 6, in the sealed connector subassembly 22, the keying member 70 of the terminal position assurance and locking cover 18 extends through the seal opening 64 and into the housing recess 38 to align the terminal receiving apertures 80 and 62 with respective housing channels 26. The terminal position assurance and locking cover 18 is secured to the housing 12 in the preassembled condition by the latching protuberances 72 received within the housing apertures 46. In this condition, protuberances 74 are not in engagement with tabs 44.

Having reference to FIGS. 4, 5, 6 and 7, the terminal position assurance feature of the connector cover is now described. FIG. 6 illustrates the sealed connector subassembly 22 prior to the insertion of the terminals 14 with the terminated conductors 24 into the housing 12. The retaining arms 34 are molded to resiliently bias the locking fingers 36 of the resilient retaining arms 34 to extend within the housing recesses 26 as shown in FIG. 6. When the terminals 14 are inserted within the housing recesses 26, the locking fingers 36 of the retaining arms 34 are deflected radially inwardly as shown in FIG. 4 within the rear housing cavity 39 and in broken line in FIG. 7. When each of the terminals 14 is fully inserted the housing recess 26, the associated locking finger 36 moves within the terminal locking window 32 providing tactile and audible user feedback indication.

After the terminals 14 with the terminated conductors 24 are fully inserted within the housing recesses 26, the terminal position assurance and locking cover 18 is moved into locking position as shown in FIG. 5. Keying member 70 engages each of the retaining arms 34 to retain the locking fingers 36 in a positively locked position in the terminal locking windows 32. If the terminals 14 are not fully inserted and/or properly positioned within the housing recesses 26, movement of the terminal position assurance and locking cover 18 into locking position is prevented.

As the cover 18 is moved from the preassembled position, protuberances 72 move axially along apertures 46. Protuberances 74 engage tabs 44, deflect the tabs and then enter apertures 48 to lock cover 18 into place in housing 12 in the final position. Seal 16 is compressed in the axial direction between body 82 of cover 18 and wall 28 of housing 12 and is compressed radially by portion 78 of keying member 70. A reliable seal is made to each conductor 24, to the housing 12 and to the cover 18.

Referring to FIG. 4, removal of a terminal 14 is enabled by pulling the locking cover 18 outwardly to move the keying member 70 to the subassembly latching position. A tool (not shown) is inserted in the direction indicated by arrow labelled 90. Force is applied against the free end of the retaining arm 34 to release the locking finger 36 from locking window 32 as indicated by an arrow labelled 92. Then the terminal 14 can be removed for repair or replacement.

Although the present invention has been described in connection with details of the preferred embodiment, many alterations and modifications may be made without departing from the invention. Accordingly, it is intended that all such alterations and modifications be considered as within the spirit and scope of the invention as defined in the appended claims.

We claim:

1. A sealed connector including at least one terminal terminating an associated conductor, said sealed connector comprising:
- a housing having at least one terminal receiving channel extending from a terminal entry wall toward an opposed mating wall;
- said housing having resilient arm means extending within said terminal receiving channel for retaining the terminal within the terminal receiving channel;
- said housing including sleeve means extending axially outwardly from said terminal entry wall for defining a seal receiving cavity;
- a connector cover having at least one aperture for receiving said terminal;
- a seal having at least one aperture for receiving said terminal disposed within said housing seal receiving cavity between said housing terminal entry wall and said connector cover;
- said connector cover including terminal position assurance means cooperating with said housing terminal retaining means for securing the terminal within the terminal receiving channel; and
- said housing and said connector cover including cooperating locking means for securing said connector cover to said housing.

2. A sealed connector as recited in claim 1 wherein said housing comprises an integrally formed member.

3. A sealed connector as recited in claim 1 wherein said seal is adapted for compression engagement with said housing sleeve means.

4. A sealed connector as recited in claim 1 wherein said seal is adapted for compression engagement with the terminated conductor.

5. A sealed connector as recited in claim 1 wherein said connector cover comprises an integrally formed member.

6. A sealed connector as recited in claim 1 wherein said connector cover terminal position assurance means comprises an elongated member and said housing and said seal include corresponding passageways for receiving said elongated member.

7. A sealed connector as recited in claim 6 wherein said elongated member and said housing and said seal corresponding passageways for receiving said elongated member are shaped for keying, whereby said terminal receiving channels of said housing and said apertures of said seal and said connector cover are aligned.

8. A sealed connector as recited in claim 1 wherein said housing is adapted for releasably retaining the terminal, whereby the terminal can be removed.

9. A sealed connector subassembly for receiving at least one terminal with an associated terminated conductor, said sealed connector subassembly comprising:
- a housing having at least one terminal receiving channel extending from a terminal entry wall toward an opposed mating wall;
- said housing having resilient arm means extending within said terminal receiving channel for retaining the terminal within the terminal receiving channel;
- said housing including sleeve means extending axially outwardly from said terminal entry wall for defining a seal receiving cavity;
- a connector cover having at least one aperture for receiving said terminal;
- a seal having at least one aperture for receiving said terminal disposed within said housing seal receiving cavity between said housing terminal entry wall and said connector cover;
- said connector cover including terminal position assurance means cooperating with said housing terminal retaining means for securing the terminal within the terminal receiving channel;
- said housing and said connector cover including cooperating latching means for securing said connector cover to said housing in a preassembled condition of the sealed connector subassembly; and
- said housing and said connector cover including cooperating locking means for securing said connector cover to said housing in a final assembled condition.

10. A sealed connector subassembly as recited in claim 9 wherein said housing comprises an integrally formed member.

11. A sealed connector subassembly as recited in claim 9 wherein said seal is adapted for compression engagement with said housing sleeve means.

12. A sealed connector subassembly as recited in claim 9 wherein said seal is adapted for compression engagement with the terminated conductor.

13. A sealed connector subassembly as recited in claim 9 wherein said connector cover comprises an integrally formed member.

14. A sealed connector subassembly as recited in claim 9 wherein said connector cover terminal position assurance means comprises an elongated member and said housing and said seal include corresponding passageways for receiving said elongated member.

15. A sealed connector subassembly as recited in claim 14 wherein said elongated member and said housing and said seal corresponding passageways for receiving said elongated member are shaped for keying, whereby said terminal receiving channels of said housing and said apertures of said seal and said connector cover are accurately aligned.

16. A sealed connector subassembly as recited in claim 9 wherein said housing is adapted for releasably retaining the terminal, whereby the terminal can be removed.

17. A sealed connector including a plurality of terminals, each terminal terminating an associated conductor, said sealed connector comprising:

a housing having a plurality of spaced apart terminal receiving channels extending from a terminal entry wall toward an opposed mating wall;

said housing having resilient arm means extending within said terminal receiving channels for retaining one said terminal within each of the terminal receiving channels;

said housing including sleeve means extending axially outwardly from said terminal entry wall for defining a seal receiving cavity;

a connector cover having a plurality of spaced apart apertures each for receiving one said terminal;

a seal having a plurality of spaced apart apertures, each for receiving one said terminal, said seal being disposed within said seal receiving cavity between said housing terminal entry wall and said connector cover;

said connector cover, said seal and said housing including cooperating keying means for keying said housing and said seal and said connector cover;

said connector cover keying means cooperating with said housing terminal retaining means for securing the terminal within the terminal receiving channel; and said housing and said connector cover including cooperating locking means for securing said connector cover to said housing.

18. A sealed connector as recited in claim 17 wherein said connector cover keying means for keying said housing, said seal and said connector cover comprises an elongated D-shaped member and wherein said seal and said housing cooperating keying means comprises corresponding D-shaped passageways for receiving said connector cover D-shaped member.

19. A sealed connector as recited in claim 18, said housing resilient arm means being disposed for engagement with said connector cover elongated D-shaped member for retaining a locking finger of each arm means within a terminal locking window.

20. A sealed connector as recited in claim 17 wherein said housing and said connector cover include cooperating latching means for securing said connector cover to said housing in a subassembly position.

21. A sealed connector including a plurality of terminals, each terminal terminating an associated conductor and having at least one locking window, said sealed connector comprising:

a housing having a plurality of spaced apart terminal receiving channels extending from a terminal entry wall toward an opposed mating wall;

said housing having resilient arm means extending within said terminal receiving channels for retaining one said terminal within each of the terminal receiving channels;

said housing including sleeve means extending axially outwardly from said terminal entry wall for defining a seal receiving cavity;

a connector cover having a plurality of spaced apart apertures each for receiving one said terminal;

a seal having a plurality of spaced apart apertures, each for receiving one said terminal, said seal being disposed within said seal receiving cavity between said housing terminal entry wall and said connector cover;

said connector cover, said seal and said housing including cooperating keying means for keying said housing and said seal and said connector cover; said connector cover including an elongated D-shaped keying member and said seal and said housing including corresponding D-shaped keying passageways for receiving said connector cover D-shaped member;

said housing resilient arm means being disposed for engagement with said connector cover elongated D-shaped member for supporting a locking finger of each arm means within the terminal locking window for securing the terminal within the terminal receiving channel; and said housing and said connector cover including cooperating locking means for securing said connector cover to said housing.

* * * * *